US005248123A

United States Patent [19]

Richeson et al.

[11] Patent Number: 5,248,123

[45] Date of Patent: Sep. 28, 1993

[54] PILOT OPERATED HYDRAULIC VALVE ACTUATOR

[75] Inventors: William E. Richeson; Frederick L. Erickson, both of Fort Wayne, Ind.

[73] Assignee: North American Philips Corporation, New York, N.Y.

[21] Appl. No.: 805,145

[22] Filed: Dec. 11, 1991

[51] Int. Cl.[5] ..... F16K 31/124

[52] U.S. Cl. ..... 251/29; 91/394; 91/461; 123/90.11; 123/90.12; 251/30.01; 251/31

[58] Field of Search ..... 91/394, 461; 123/90.11, 123/90.12, 90.13; 251/29, 30.01, 31

[56] References Cited

U.S. PATENT DOCUMENTS

| | | | |
|---|---|---|---|
| 3,425,449 | 2/1969 | Leibfritz | 137/625.64 |
| 4,266,572 | 5/1981 | Schuttenberg et al. | 137/625.64 X |
| 4,907,615 | 3/1990 | Meyer et al. | 137/625.64 X |
| 4,930,464 | 6/1990 | Letsche | 123/90.12 |
| 4,974,495 | 12/1990 | Richeson | 123/90.12 X |
| 5,022,358 | 6/1991 | Richeson | 123/90.12 |

FOREIGN PATENT DOCUMENTS

| | | | |
|---|---|---|---|
| 2552492 | 3/1985 | France | 123/90.12 |

*Primary Examiner*—Gerald A. Michalsky

[57] ABSTRACT

A housing has a pilot bore with an electrically controlled pilot valve therein, an intermediate bore with an intermediate valve therein, and an engine bore with a main valve therein, each valve being reciprocable between first and second stable positions. When said pilot valve is switched to its first stable position, high pressure hydraulic fluid drives said intermediate valve to its first stable position and releases said engine valve from its second stable position, whereupon a double acting spring drives the engine valve toward its first stable position. High pressure hydraulic fluid completes this movement then holds the main valve in its first stable position against the force of the double acting spring. Switching the pilot valve to its second stable position effects movement of the other valves back to their second stable positions.

12 Claims, 9 Drawing Sheets

PILOT OPERATED HYDRAULIC VALVE ACTUATOR

BACKGROUND OF THE INVENTION

The present invention relates to a bistable, electronically controlled valve actuator where the motive power for an engine valve is provided by high pressure hydraulic fluid.

Internal combustion engine valves are almost universally of a poppet type which are spring loaded toward a valve-closed position and opened against the spring bias by a rotating cam which is synchronized with the engine crankshaft to achieve opening and closing at fixed times in the engine cycle. This fixed timing is a compromise between the timing best suited for high engine speed and the timing best suited to lower speeds including idling. Power and efficiency are likewise compromised.

The prior art has recognized numerous advantages which might be achieved by replacing cam actuated valve arrangements with other types of valve mechanisms which could be controlled as a function of engine speed, crankshaft position, and other engine parameters. For example, U.S. Pat. No. 4,009,695 discloses hydraulically actuated engine valves each controlled by an intake pintle valve and an outlet pintle valve having respective solenoids which in turn are controlled by a dashboard computer which monitors a number of engine operating parameters. This patent recites many advantages which could be achieved by such independent valve control, but is not able to achieve these advantages due to the slow acting nature of its hydraulics Further, since the patented arrangement attempts to control the valves on a real time basis, the overall system is one with feedback and thus subject to oscillatory behavior.

U.S. Pat. No. 4,945,870, which is hereby incorporated by reference, is entitled VEHICLE MANAGEMENT COMPUTER and discloses a computer control system which receives a plurality of engine operation sensor inputs and in turn controls a number of engine operating parameters including ignition timing, valve timing, and fuel-air mixture. This patent teaches numerous operating modes or cycles in addition to the conventional four stroke cycle, and summarizes numerous prior art schemes for electronic control of engine valves. These schemes include, inter alia, valves which are pneumatically powered and pneumatically or magnetically latched. Magnetic latching may be by solenoids or by permanent magnets which are subjected to an opposed electromagnetic pulse to achieve release. U.S. Pat. No. 4,899,700 discloses control valves and latching plates which are separate from the working piston on the main valve, which results in lower latching forces and reduced mass, resulting in faster operating times.

U.S. Pat. No. 4,974,945, which is hereby incorporated by reference, is entitled ELECTRO-HYDRAULIC VALVE ACTUATOR and discloses a hydraulically powered, electronically controlled valve actuator including a main shaft having a working piston reciprocable in a cylinder defined by a ported sleeve fixed in a housing. A tubular control valve located radially intermediate the sleeve and also having ports is reciprocable to control access between high and low pressure sections of an adjacent reservoir of hydraulic fluid, and the opposed working surfaces of the piston. The control valve is latched by permanent magnets and released by a pulsed electromagnetic field that opposes the permanent magnets.

While U.S. Pat. No. 4,974,945 achieves adequate response times by reducing the length of the fluid paths between the reservoir and the cylinder, it is rendered complex by the presence of springs and pistons in the fluid reservoir and additional springs which provide the motive force for the control valve.

SUMMARY OF THE INVENTION

The present invention is addressed to a hydraulically powered, electronically controlled valve actuator which achieves fast response times with a minimum number of moving parts.

The actuator comprises a housing having parallel bores which receive respective spool valves as follows: a pilot valve, an intermediate valve, an engine valve, and an initializer valve. Each spool valve is reciprocable between first and second stable positions and has one or more constrictions which permit communication between different fluid galleys in the housing. The pilot valve undergoes only very short axial movement and thus may be latched by a simple solenoid without the need for additional springs or magnets. This short movement determines which of first and second working galleys are in fluid communication with a first high pressure galley in the housing. When the pilot valve is in its first stable position, the first working galley directs high pressure fluid to a first working surface of the intermediate valve, thus maintaining the intermediate valve in its first stable position. When the pilot valve is in its second stable position, the second working galley directs high pressure fluid to a second working surface of the intermediate valve, thus shifting the intermediate valve to its second stable position.

When the intermediate valve is in its first stable position, a first constriction profiled thereon permits fluid communication between said first high pressure galley and the first working surface of the working piston of the main valve via a third working galley. When the intermediate valve is in its second stable position, a second constriction profiled thereon permits fluid communication between said first high pressure galley and the second working surface of the working piston via a fourth working galley.

At the instant the pilot valve shifts from first to second stable positions, followed immediately by a shifting of the intermediate valve, the working piston of the engine valve is actually exposed to high fluid pressure on both working surfaces. However, a double acting coil spring on the engine valve stem externally of the housing causes the working piston to begin moving. This spring was fully loaded when the engine valve was finally urged to its first stable position by high pressure fluid on only the first working surface. As the loaded spring accelerates the engine valve away from its first stable position, high pressure fluid is transferred from the first to the second working surfaces by a high pressure connecting galley which communicates with the second constriction of the intermediate valve. As the engine valve moves through an intermediate position, the piston cuts off the high pressure connecting galley and high pressure fluid is transferred to the second working surface via ports and a constriction on an adjacent initializing valve. Finally, as the engine valve begins to lose the momentum imparted by the double acting spring, communication between first and second working surfaces is cut off and fluid escapes from the collapsing portion of the working chamber to the third working galley, now at low pressure. Since high pressure fluid acts only on the second working surface of the piston, the double acting spring is again fully loaded as the engine valve reaches its second stable position. The engine valve remains in this position until a signal from the engine control computer (cf. U.S. Pat. No. 4,945,870) commands the pilot valve to shift back to its first stable position, which triggers the hydraulic fluid transfer necessary to open the intake or exhaust valve of the engine.

The initializer valve mentioned above is spring loaded in a first stable position when the vehicle is not running. The intermediate valve is also spring loaded in its first stable position, while the engine valve assumes an intermediate position by virtue of the double acting spring. When the ignition is activated, the pilot valve is in its first stable position and high pressure fluid bears against the first working surface of the piston, while low pressure fluid escapes from the collapsing portion of the working chamber to the fourth working galley via the constriction on the initializer. Meanwhile, the initializer valve, under the influence of high pressure against its sole working surface, commences movement toward its second stable position, where it remains during engine operation.

The pilot operated hydraulic actuator according to the invention permits a high speed action of the engine valve without the large electromagnetic devices which would be necessary if associated directly with the engine valve. The small, low mass pilot valve permits control with a small electromagnetic device which consumes very little energy.

The double acting spring allows for final damping of the engine valve as it reaches its first and second stable positions, and at the same time converts the kinetic energy of the valve into potential energy in the spring. This reduces the overall energy consumption of the actuator, and minimizes the transfer of hydraulic fluid.

Finally, the parallel positioning of the bores for the spool valves permits short, large aperture galleys which minimize throttling losses in the moving fluid. Some valve overlap as fluid transfer channels change during motion of the main valve also prevent the extreme pressures which can result in leakage and hydraulic hammering.

DETAILED DESCRIPTION OF THE PREFERRED EMBODIMENT

Figure 1:
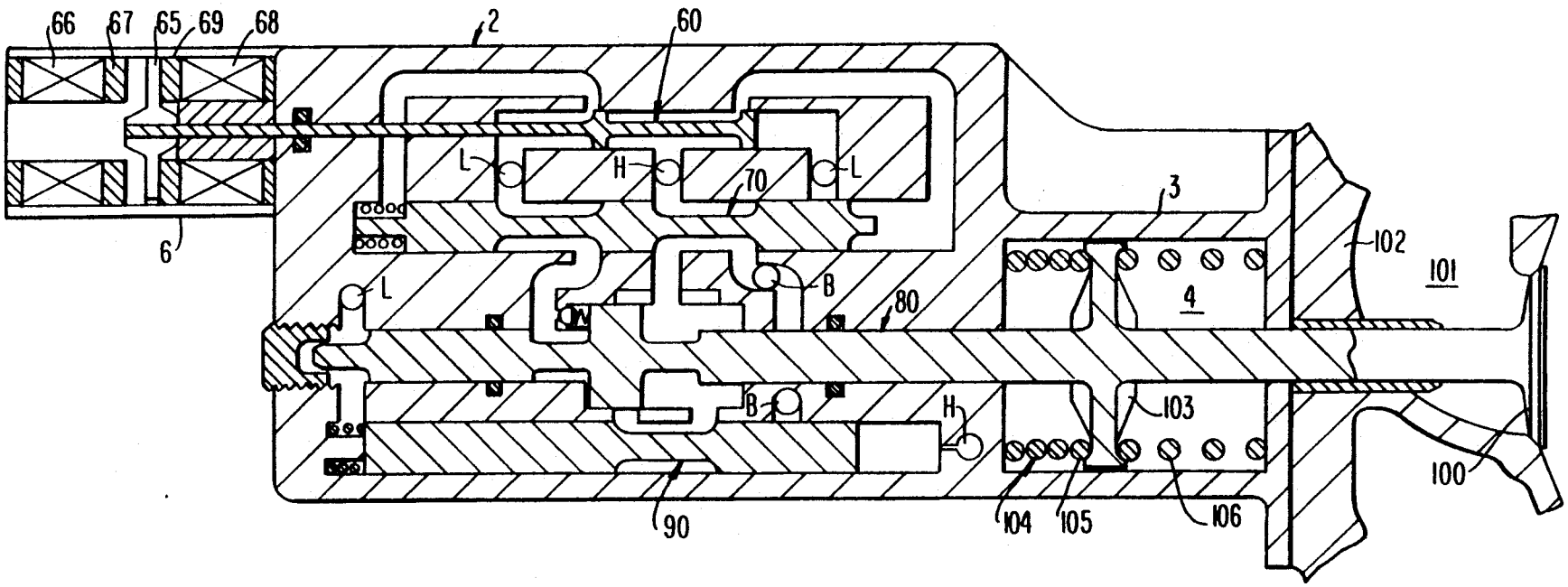
FIG. 1 is a cross section of the valve actuator including the solenoids, engine valve, and double acting spring.

FIG. 1 shows the valve actuator housing 2 which receives the pilot valve 60, intermediate valve 70, engine valve 80, and initializer valve 90 in respective bores in the housing. The positions of valves as shown here will be described more completely in conjunction with FIG. 7. The main valve 80 includes the valve face 100 which closes port 101 in head 102, and further includes a disc 103 borne against by first and second springs 105, 106 of double acting spring assembly 104. The housing 2 has an extension 3 containing chamber 4 which houses the double acting spring 104. A solenoid housing 6 fixed to the other end of housing 2 contains solenoids 66, 68 which activate respective magnets 67, 69 to drive a ferromagnetic disc 65 fixed to one end of the pilot valve 60.

Figure 2:
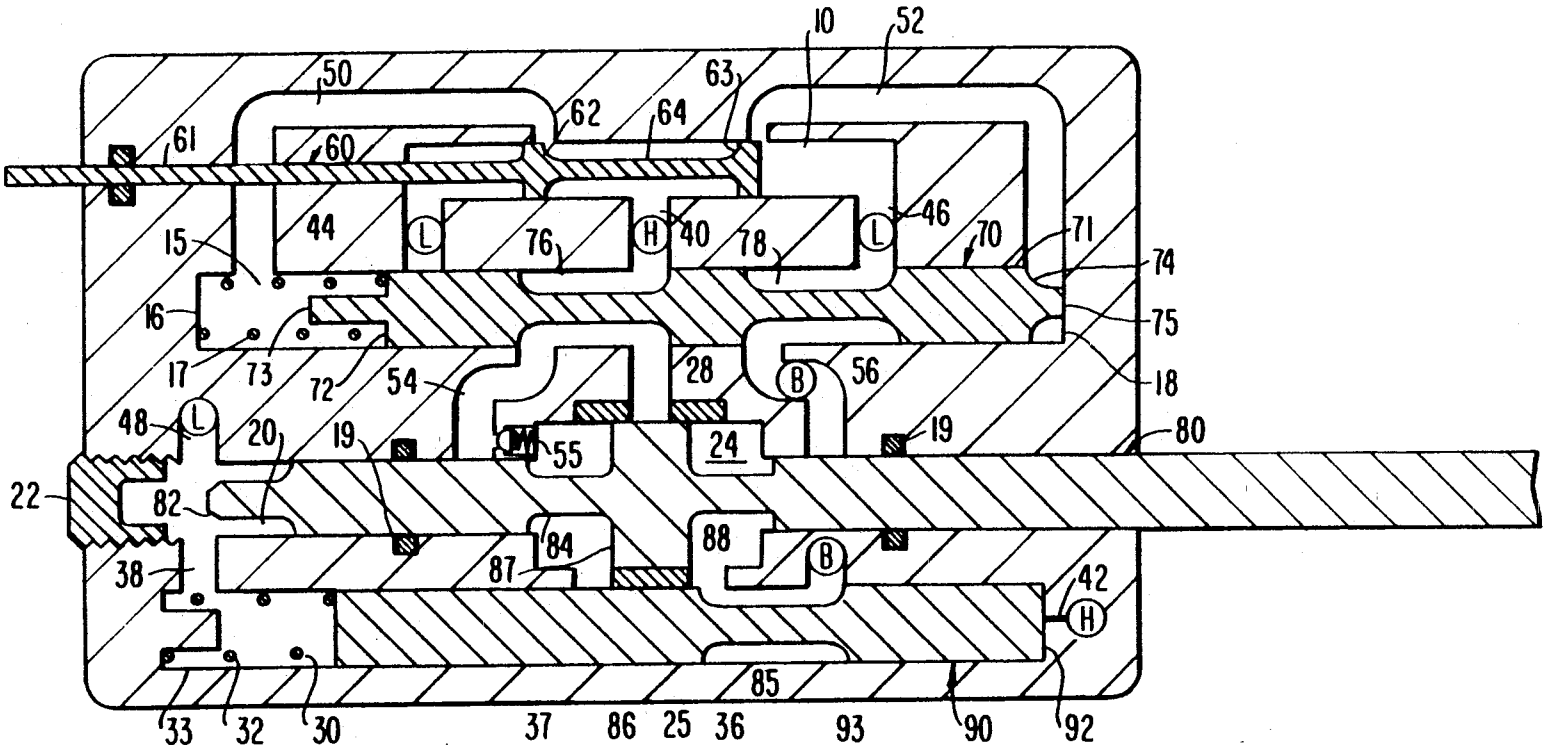
FIG. 2 is a cross section of the valve actuator in the quiescent state, with the pilot valve, the intermediate valve, and the initializing valve in their first stable positions, the engine valve in an intermediate position.

Referring to FIG. 2, the valve actuator housing 2 has a pilot bore 10 for pilot valve 60, an intermediate bore 15 for intermediate valve 70, a main bore 20 for engine valve 80, and an initializer bore 30 for initializer valve 90. The double acting spring and the solenoids have been omitted from this view for simplicity. A source of high pressure hydraulic fluid, e.g. at 2500 psi, is connected to first and second high pressure galleys 40, 42 via ports marked "H". A source of low pressure hydraulic fluid, e.g. at 100 psi, is connected to first, second, and third low pressure galleys 44, 46, 48 via ports marked "L". The sources, which may be accumulators external to the housing, are not shown.

The first high pressure galley 40 connects the pilot bore 10 to the intermediate bore 15 between the first and second low pressure galleys 44, 46, which likewise connect the pilot bore 10 to the intermediate bore 15 A first working galley 50 connected to the pilot bore 10 between the galleys 40, 44 communicates with a first end 16 of the intermediate bore 15. A second working galley 52 connected to the pilot bore 10 between the galleys 40, 46 communicates with a second end 18 of the intermediate bore 15. A connecting galley 28, which receives high pressure fluid from galley 40, connects the intermediate bore 15 to the working chamber 24 of main bore 20. Third and fourth working galleys 54, 56 connect the intermediate bore 15 to the main bore 20 on either side of the working chamber 24. The third working galley 54 contains a spring loaded ball valve 55 which permits flow of hydraulic fluid into chamber 24.

The pilot valve 60 includes a stem 61, a first disk-like piston 62, a second disk-like piston 63, and a constriction 64 therebetween. The stem 61 is received through an access bore 12 in the housing, which bore has an annular channel for seal 13 to prevent fluid leakage. Externally of the housing, a double acting magnetic latch comprising solenoids 66, 68 acts on ferromagnetic disc 65 fixed to the stem to reciprocate the pilot valve 6 between first and second stable positions (FIG. 1). As shown in FIG. 2, the pilot valve 60 is in its first stable position, wherein the constriction 64 permits communication between first high pressure galley 40 and the first working galley 50. The piston 63 cuts off the high pressure galley 40 from the second working galley 52, which in the position shown communicates with the second low pressure galley 46.

The intermediate valve 70 includes a shaft 71, whose outer cylindrical surface is closely received in intermediate bore 15, and a first working surface 72 with an end stop 73 which permits fluid communication with first working galley 50 regardless of valve position. As shown in FIG. 1, intermediate valve 70 is in its first stable position, where it is urged to the right by a coil spring 17 in the first end 16 of the bore 15. A second working surface 74 with an end stop 75 bears against second end 18 of the intermediate bore 15. In the first stable position, as shown, a first constriction 76 permits communication between first high pressure galley 40, high pressure connecting galley 28, and the third working galley 54. A second constriction 78 permits communication between the second low pressure galley 46 and fourth working galley 56.

Referring still to FIG. 2, the engine valve 80 includes a shaft 81 closely received in main bore 20 having seals 19, and a working piston 86 having opposed first and second working surfaces 87, 88. The piston 86 is closely received in a sleeve 25 fitted in the working chamber 24. First constriction 84 permits fluid communication between the third working galley 54 and first working surface 87 (first stable position), while second constriction 85 permits fluid communication between fourth working galley 56 and second working surface 88 (second stable position). The high pressure connecting galley 28 may be in communication with either working surface, depending on position. In the position shown, engine valve 80 is in an intermediate position between its first and second stable positions. This is the "quiescent" state, where it would rest under the action of double acting spring 104 (FIG. 1) in the absence of any hydraulic power. The engine valve 80 further includes an end stop 82 which permits fluid communication with third low pressure galley 48 regardless of valve position; the stop 82 is configured to be closely received in a damping thimble 22 threaded into the end of main bore 20.

FIG. 2 is the only figure showing the initializer valve 90 in its first stable position, where it is maintained by coil spring 32 about stop 33 in the bore 30. This assumes the absence of any high pressure in the second high pressure galley 42, whereby the working surface 92 is not driven. The sole constriction 93 communicates between a fifth working galley 58, which is always at common pressure with fourth working galley 56 via ports marked "B", and a first transfer port 36 between the initializer bore 30 and the working chamber 24. In the position shown, a second transfer port 37 is cut off by the initializer valve 90. A low pressure connecting galley 38 between the main bore 20 and the initializer bore 30 will always be in fluid communication with the third low pressure galley 48.

Figure 3:
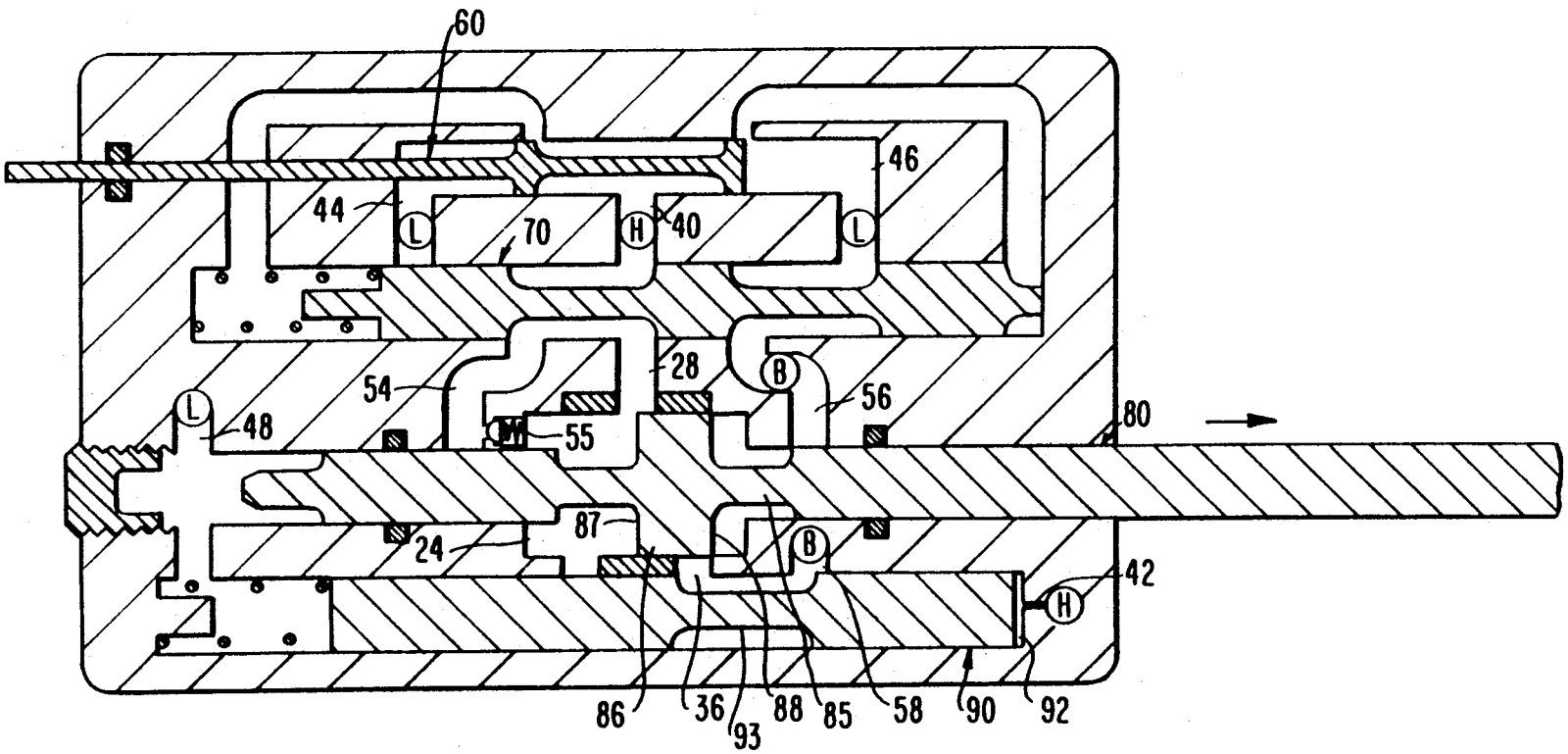
FIG. 3 is similar to FIG. 2 but shows the engine valve moving toward its first sable position and the initializing valve moving toward its second stable position.

FIG. 3 shows the first action step when the system is activated; this will generally be when the ignition of an automobile is activated and high pressure fluid is brought to bear in high pressure galleys 40, 42 (marked with an "H"), while low pressure fluid is brought to bear in low pressure galleys 44, 46, 48 (marked with an "L"). The pilot valve 60 and the intermediate valve 70 remain in their first stable positions, while the engine valve 80 begins movement toward its first stable position (to the right) under the action of high pressure fluid acting on first working surface 87 of the piston 86. The high pressure fluid enters the working chamber 24 via ball valve 55 in third working galley 54. In the position shown, the working piston 86 has just passed (and opened) the high pressure connecting galley 28, whereby the volume rate of flow into the working chamber 24 is increased. Recall that the counteracting force of the double acting spring 104 (FIG. 1) increases as a stable position is approached. Low pressure fluid against the second working surface 88 initially escapes from the working chamber 24 through first connecting port 36 and fifth working galley 58 (presently in common with second low pressure galley 46), via constriction 93 of the initializer valve. As movement of the main valve progresses, low pressure fluid then escapes directly to the fourth working galley 56 via second constriction 85 of the engine valve. Meanwhile, the initializer valve 90 commences migration toward its second stable position (to the left) under the force of high pressure fluid from second high pressure galley 42, acting on its working surface 92.

Figure 4:
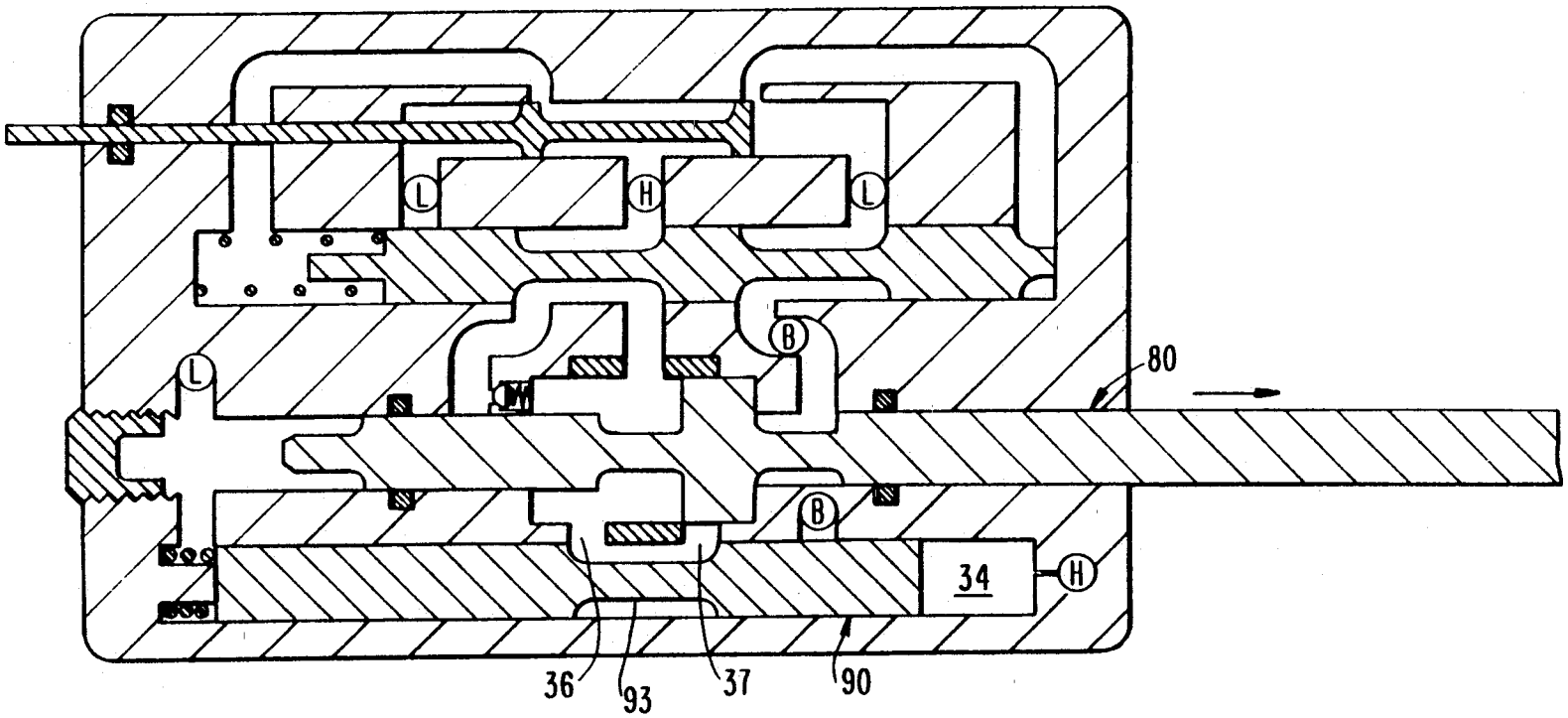
FIG. 4 is a cross section of the actuator in the initialized state, with the pilot valve, the intermediate valve and the engine valve in their first stable positions, the initializing valve in its second stable position.

FIG. 4 shows the actuator assembly "fully initialized", that is, the engine valve 80 is in its first stable position (fully to the right), and the initializer valve 90 is in its second stable position (fully to the left). The intake and exhaust ports of the engine are fully open, and timed operation of the main valves is ready to begin. Note that the initializer valve 90 will now remain in its second stable position by virtue of high pressure fluid in chamber 34, and first and second transfer ports 36, 37 will remain in fluid communication via constriction 93 of the initializer valve 90.

Figure 5:
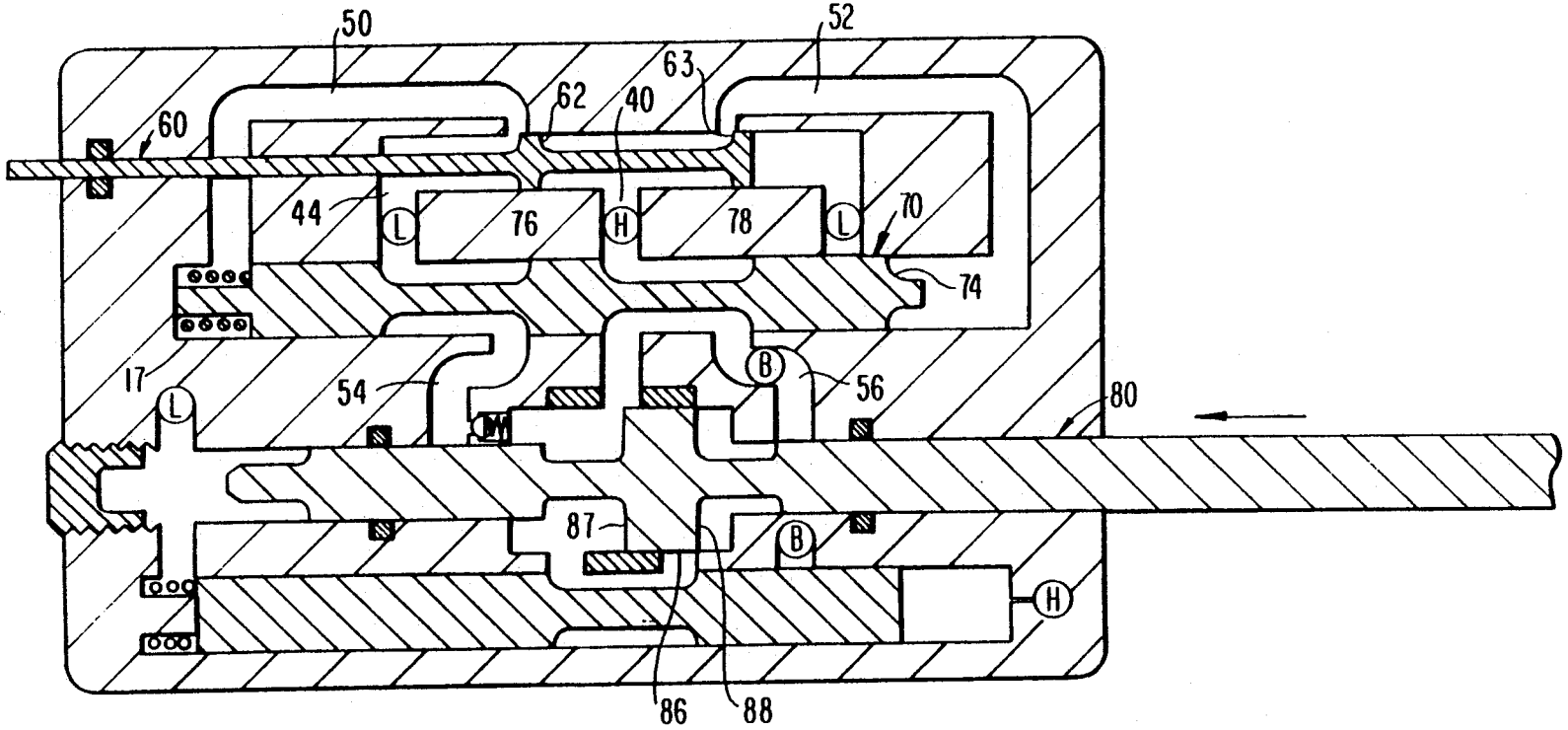
FIG. 5 shows the pilot valve and the intermediate valve in their second stable positions, the engine valve moving toward its second stable position.

As shown in FIG. 5, the pilot valve 60 will move to its second stable position (to the right) when timing determined by a central engine computer actuates the magnetic latch. Via movement of first disk-like piston 62, the first working galley 50 now communicates with first low pressure galley 44. Via movement of second disk-like piston 63, the second working galley 52 now communicates with first high pressure galley 40. This brings high fluid pressure to bear against the second working surface 74 of the intermediate piston 70, causing it to move to its second stable position (as shown) compressing spring 17 and causing low pressure fluid to escape into the first working galley 50. Third working galley 54 is now in fluid communication with first low pressure galley 44 via first constriction 76, and fourth working galley 56 is in fluid communication with first high pressure galley 40 and connecting galley 28 via second constriction 78. This clearly imposes equal hydraulic pressure on both working surfaces 87, 88 of piston 86, but recall that the double acting spring 104 (FIG. 1) is fully loaded and will thus urge the engine valve 80 toward its second stable position (to the left). The engine valve 80 is thus shown moving to the left, forcing low pressure fluid into the third low pressure galley 48.

Figure 6:
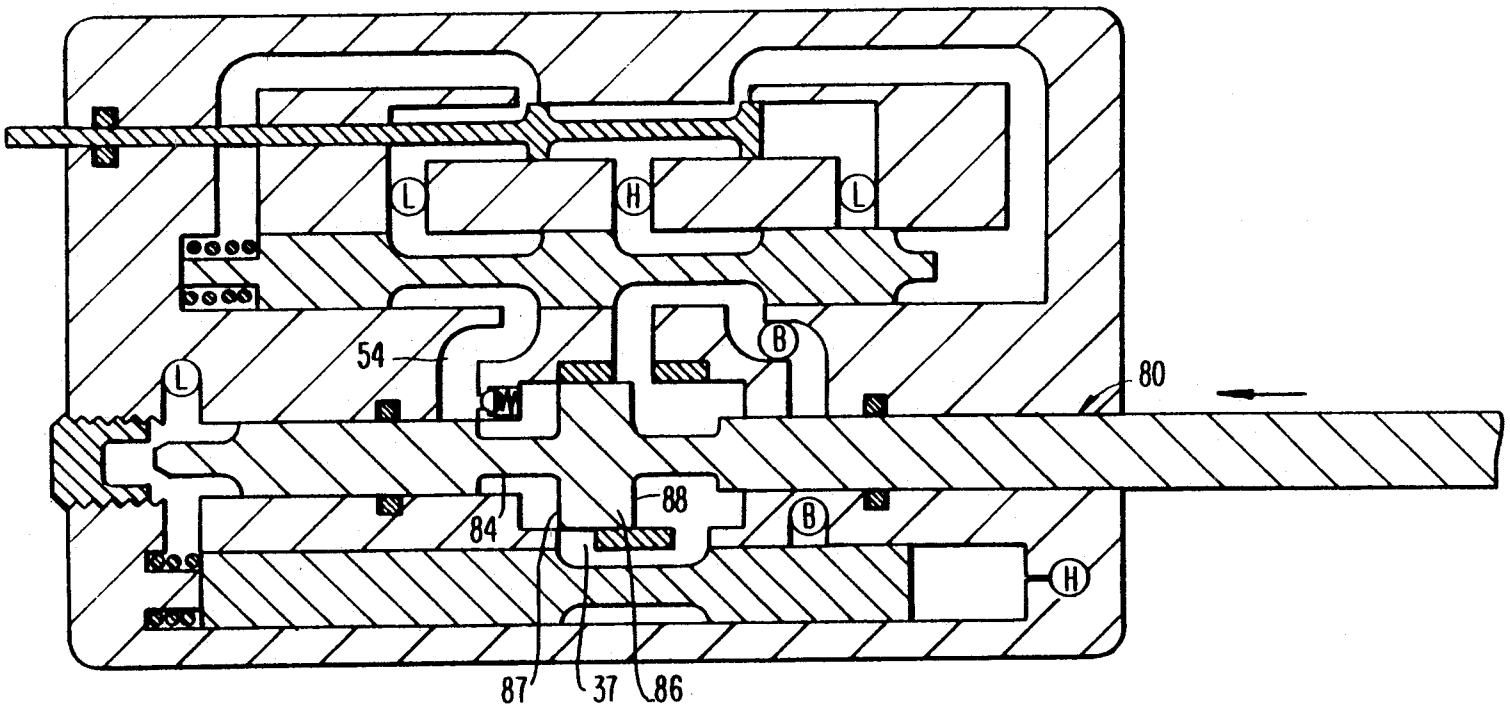
FIG. 6 is similar to FIG. 5 but shows the main valve closer to its second stable position.

FIG. 6 is similar to FIG. 5 but shows the engine valve 80 closer to its second stable position. Here the engine valve 80 is still moving under the momentum imparted by the double acting spring, but the working piston 86 has just closed off the second connecting port 37 so that high pressure fluid is no longer available to the first working surface 87. At this time the constriction 84 has just reached the third working galley 54, which is still at low pressure as described in conjunction with FIG. 5. Low pressure fluid thus escapes to galley 54 while high pressure fluid acts only on the second working surface 88, thus overcoming the increasing resistance of the double acting spring.

Figure 7:
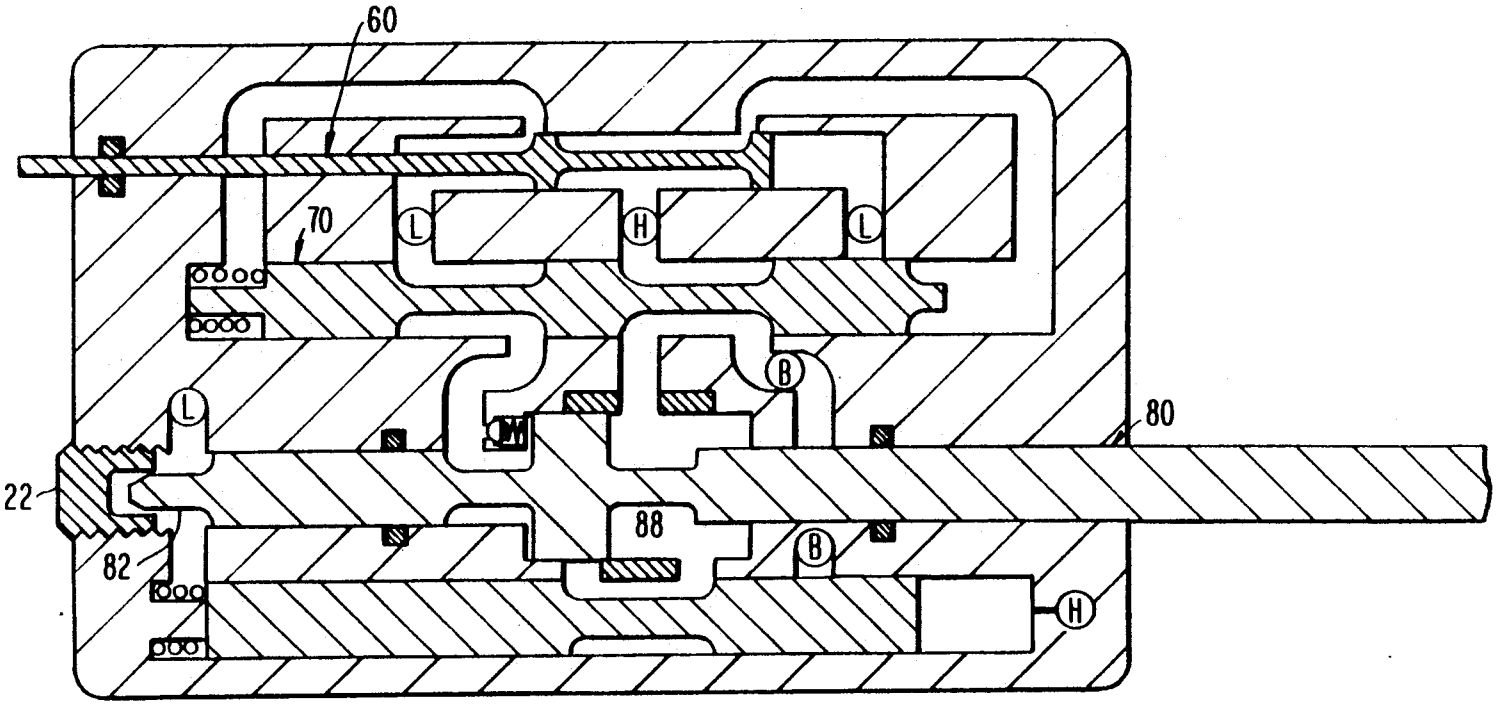
FIG. 7 shows the pilot valve, the intermediate valve, the main valve, and the initializing valve all seated in their second stable positions.

FIG. 7 shows the engine valve 80 fully seated in its second stable position, the intake or exhaust port of the engine thus being fully closed. The valve 80 will remain in this position so long as high pressure fluid acts on second working surface 88, which will be the case so long as the system is active and the pilot valve 60 and intermediate 70 remain in their second stable positions as shown. Note that the stop 82 has been received in damping thimble 22. The displacement of hydraulic fluid from thimble 22 as valve face 100 is fully seated provides a damping action which may be adjusted by turning the threaded thimble to move it further into or out of the main bore, which is tapped where it receives the thimble. Referring briefly to FIG. 1, the spring 104 is fully compressed, while the solenoid 68 is energized in order to activate magnet 69 to hold disc 65 thereagainst.

Figure 8:
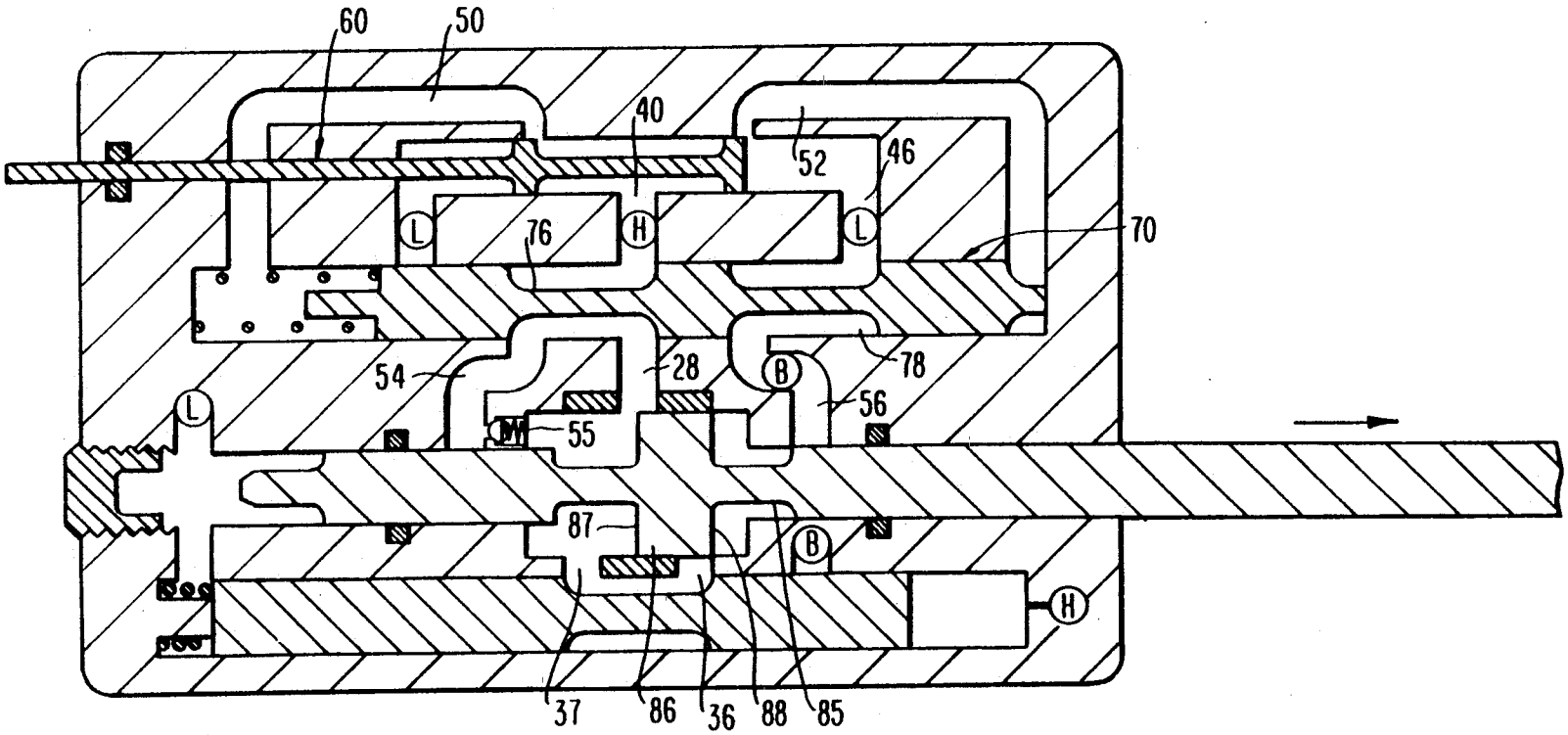
FIG. 8 shows the pilot valve and the intermediate valve back in their first stable positions and the main valve moving toward its first stable position.

FIG. 8 shows the valve actuator assembly after the central engine computer which controls the valve timing has provided the signal which energizes solenoid 66 (FIG. 1) and causes the pilot valve 60 to return to its first stable position (to the left). The high pressure galley 40 is again connected to the first working galley 50 while the low pressure galley 46 is connected to second working galley 52, which has caused the intermediate valve 70 to return to its first stable position. The constriction 76 of the intermediate valve 70 has thus connected the high pressure galley 40 to the third working galley 54 and the high pressure connecting galley 28, while the constriction 78 has connected the second low pressure galley 46 to the fourth working galley 56.

As the engine valve 80 commences movement from its second stable position, then, high pressure fluid will bear on both working surfaces 87, 88 of piston 86, and high pressure fluid will be exchanged between these surfaces via constriction 76 and ball valve 55. Recall that the fully loaded double acting spring 104 (FIG. 1) is what causes the engine valve 80 to begin moving. After the piston 86 has closed off the high pressure connecting galley 28, the fluid exchange proceeds between the ports 36 and 37 via constriction 93 of the initializer valve.

When the main valve has reached the position of FIG. 8, the piston 86 has just closed off the first transfer port 36 so that high pressure fluid is no longer available to the second working surface 88. However, constriction 85 now communicates between the working chamber 24 and fourth working galley 56, which is at low pressure. Since high pressure fluid now acts only on first working surface 87, the valve 80 continues to move toward its first stable position against the increasing resistance of the double acting spring.

Once the engine valve 80 has reached the first working position, the situation of FIG. 4 again prevails, but only for the valve in question. That is, during engine operation, the valves are electronically controlled to open in turn. The other stable position, shown in FIG. 7, represents the closed position of the intake or exhaust port and prevails for most of the engine cycle.

Figure 9:
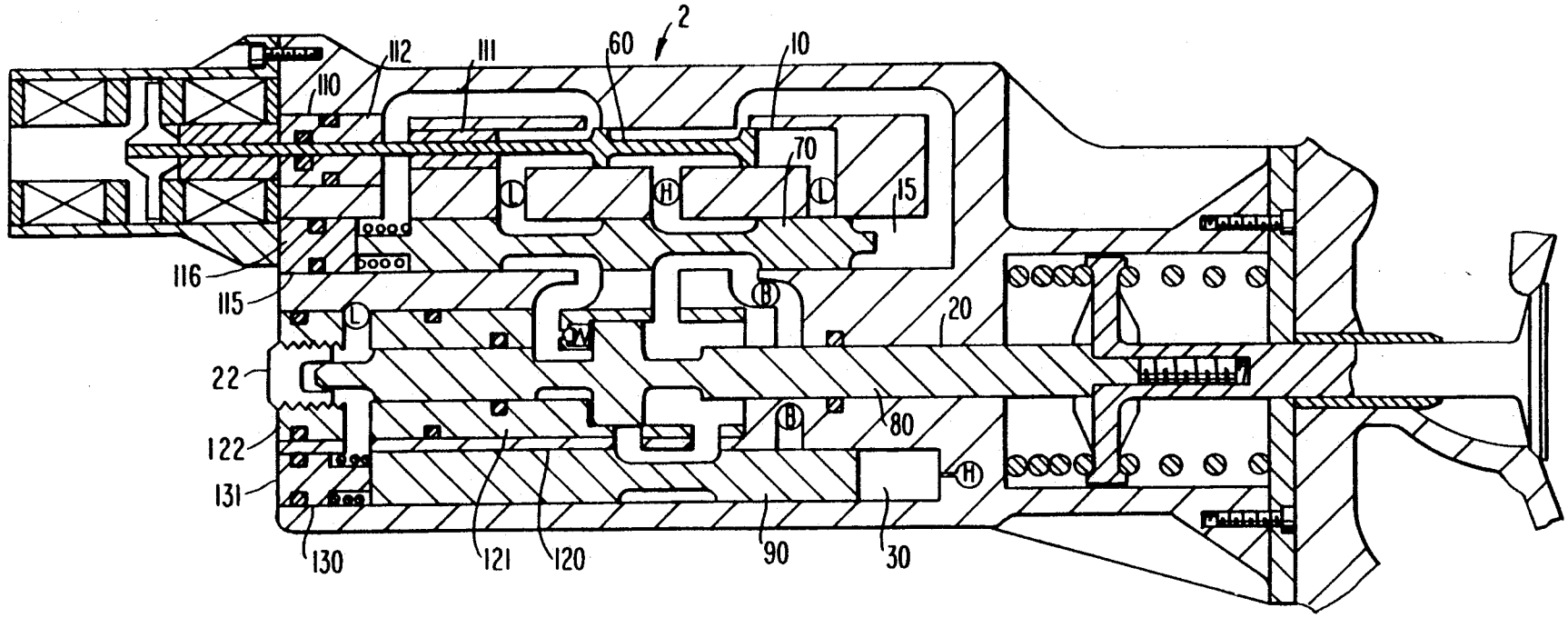
FIG. 9 is a cross section similar to FIG. 1 showing manufacturing details.

FIG. 9 is a depiction similar to FIG. 1, but shows details of the housing which enable its manufacture (these details have been omitted from other figures for simplicity). Each of the bores 10, 15, 20, 30 is preceded during manufacture by a respective access bore 110, 115, 120, 130 in the end of the housing to provide access for forming the bore with the correct tolerances for closely receiving the respective valve 60, 70, 80, and 90.

The access bore 110 receives a guide sleeve 111 which is press-fit in the housing when the pilot valve 60 is assembled. This is followed by the fitting of an end plug 112 with appropriate seals. The access bore 120 likewise receives a guide sleeve 121 which is press fit when the main valve is assembled. This is followed by an end plug 122 with attendant seals; the plug 122, in turn, receives the adjustable clamping plug 22. The access bores 115, 130 receive only end plugs 116, 131 after fitting valves 70, 90 in the respective bores 15, 30.

The basic housing 2 is most readily formed by investment casting using a wax core molded in pieces and suspended as a unit in a pattern box. This core provides all the bores, fluid galleys, and channels. All precision bores are then line drilled and reamed prior to fitting pistons, sleeves, and end caps as shown.

The solenoid housing 6 is attached to the main housing 2 by four screws. The double acting spring assembly 104 is fit into housing extension 3 when the valve 100 is threaded onto the main stem 80.

The foregoing is exemplary and not intended to limit the scope of the claims which follow.

What is claimed is:

1. An electrically controlled engine valve actuator assembly comprising a valve actuator housing having a pilot bore, an intermediate bore, and a main bore therein, high pressure galley means connected to said pilot bore for supplying hydraulic fluid from a high pressure source, low pressure galley means connected to said pilot bore for supplying hydraulic fluid from a low pressure source, an electrically controlled bistable pilot valve reciprocable in said pilot bore between first and second stable positions, a hydraulically powered bistable intermediate valve reciprocable in said bore between first and second stable positions responsive to reciprocation of said pilot valve between respective first and second stable positions, an engine valve reciprocable in said main bore between first and second stable positions and having a working piston with opposed first and second working surfaces for receiving hydraulic fluid pressure for moving said engine valve toward respective first and second stable positions, double acting spring means which, when said engine valve is in said first stable position, urges said engine valve toward said second stable position, and, when said engine valve is in said second stable position, urges said engine valve toward said first stable position, and hydraulic connecting means including said pilot valve and said intermediate valve for connecting said high pressure galley means to said first working surface and said low pressure galley means to said second working surface when said pilot valve and said intermediate valve are in their first stable positions, and for connecting said high pressure galley means to said second working surface and said low pressure galley means to said first working surface when said pilot valve and said intermediate valve are in their second stable positions.

2. A valve actuator assembly as in claim 1 wherein said intermediate valve has opposed first and second working surfaces for receiving hydraulic fluid pressure for moving said intermediate valve toward respective first and second stable positions when said pilot valve is in respective first and second stable positions.

3. A valve assembly as in claim 2 wherein said hydraulic connecting means further comprises a first working galley connecting said pilot bore to said first working surface of said intermediate valve and a second working galley connecting said pilot bore to said second working surface of said intermediate valve, and said pilot valve comprises means connecting said high pressure galley means to said first working galley and said low pressure galley means to said second working galley when said pilot valve is in said first stable position, and means connecting said high pressure galley means to said second working galley and said low pressure galley means to said first working galley when said pilot valve is in said second stable position.

4. A valve actuator assembly as in claim 3 wherein said low pressure galley means comprises first and second low pressure galleys and said high pressure galley means comprises a high pressure galley connected to said pilot bore between said first and second low pressure galleys, said pilot valve being a spool valve comprising a pair of pistons closely received in said pilot bore and a constriction defining an annular space between said high pressure galley and said first working galley while one of said low pressure galleys communicates with said second working galley when said pilot valve is in said first stable position, said space communicating between said high pressure galley and said second working galley while the other low pressure galley communicates with said first working galley when said pilot valve is in said second stable position.

5. A valve actuator assembly as in claim 2 wherein said hydraulic connecting means further comprises third galley means connecting said high pressure source to said main bore, said engine valve comprising a piston bearing said first and second working surfaces, said piston traversing said third galley as said main valve reciprocates between said first and second stable positions, thereby exposing said first working surface to high pressure when said main valve is in said first stable position and exposing said second working surface to said high pressure when said engine valve is in said second stable position.

6. A valve actuator assembly as in claim 1 wherein said engine valve is held in one of said stable positions against the force of said double acting spring means by high pressure hydraulic fluid.

7. A valve actuator assembly as in claim 1 wherein movement of said pilot valve from its first stable position to its second stable position releases high pressure hydraulic fluid from said first working surface of said working piston so that said double acting spring propels said engine valve toward said second stable position, and wherein movement of said pilot valve from its second stable position to its first stable position releases high pressure fluid from said second working surface of said piston so that said double acting spring propels said engine valve toward said first stable position.

8. A valve actuator assembly as in claim 1 further comprising transfer port means for transferring hydraulic fluid from said first working surface of said working piston to said second working surface of said working piston when said engine valve is intermediate its first and second stable positions.

9. A valve actuator assembly as in claim 1 further comprising an initializer bore in said housing, an initializer valve reciprocable in said initializer bore between first and second stable positions, siad initializer valve having a constriction thereon which permits fluid communication between one of said high and low pressure galleys and one of said first and second working surfaces of said working piston when said initializer valve is in its first stable position.

10. A valve actuator as in claim 9 wherein, when said initializer valve is in its second stable position and said engine valve is intermediate its first and second stable positions, said constriction permits fluid communication between said first and second working surfaces of said working piston.

11. Valve actuator assembly as in claim 1 wherein said pilot bore, said intermediate bore, and said main bore are parallel.

12. Valve actuator assembly as in claim 1 wherein said main bore comprises a working chamber in which said working piston reciprocates, said double acting spring means being remote from said working chamber.

* * * * *